United States Patent [19]

Cormier et al.

[11] 4,304,486

[45] Dec. 8, 1981

[54] AUTOMATIC BIAS AND REGISTRATION CONTROL SYSTEM FOR ELECTROPHOTOGRAPHIC COPIER

[75] Inventors: Raymond G. Cormier; Austin E. Davis, both of Nashua; Richard A. Bridges, Manchester; John H. Williams, Nashua, all of N.H.

[73] Assignee: Nashua Corporation, Nashua, N.H.

[21] Appl. No.: 86,749

[22] Filed: Oct. 22, 1979

[51] Int. Cl.[3] ..... G03G 15/00

[52] U.S. Cl. ..... 355/14 D; 355/8; 355/14 SH

[58] Field of Search ..... 355/14 D, 3 DD, 10, 355/8, 14 SH, 3 SH

[56] References Cited

U.S. PATENT DOCUMENTS

| | | | |
|---|---|---|---|
| 2,956,487 | 10/1960 | Giaimo | 355/14 D |
| 3,241,466 | 3/1966 | Clark | 355/3 R |
| 3,438,705 | 4/1969 | King | 355/8 |
| 3,888,579 | 6/1975 | Rodek et al. | 355/14 SH |
| 3,947,117 | 3/1976 | Basu et al. | 355/68 |
| 4,009,957 | 3/1977 | Suzuki et al. | 355/14 SH |
| 4,026,647 | 5/1977 | Kanno et al. | 355/14 SH |
| 4,050,806 | 9/1977 | Miyakawa et al. | 355/14 D |
| 4,153,364 | 5/1979 | Suzuki et al. | 355/14 D |
| 4,200,391 | 4/1980 | Sakamoto et al. | 355/14 D |
| 4,215,930 | 8/1980 | Miyakawa et al. | 355/14 D |

FOREIGN PATENT DOCUMENTS

| | | | |
|---|---|---|---|
| 2901086 | 7/1979 | Fed. Rep. of Germany | 355/14 D |
| 1413313 | 11/1975 | United Kingdom . | |

*Primary Examiner*—Richard L. Moses

*Attorney, Agent, or Firm*—Kenway & Jenney

[57] ABSTRACT

In an optical imaging system for an electrophotographic copier, a photodetector intercepts a portion of unfocused light being reflected toward the photoconductive surface. An electronic circuit generates a biasing voltage for the copier development electrode which varies with the amount of light incident on the photodetector a set time after the photodetector receives a distinctively intense light pulse reflected from a high-reflectivity strip positioned ahead of the document being copied. The time delay insures that the light which determines the bias voltage has been reflected from the main body of the document. The light pulse from the high reflectivity strip can also independently actuate the copy paper feed mechanism to insure proper image registration.

13 Claims, 8 Drawing Figures

AUTOMATIC BIAS AND REGISTRATION CONTROL SYSTEM FOR ELECTROPHOTOGRAPHIC COPIER

BACKGROUND OF THE INVENTION

The present invention relates to the field of electrophotographic copiers, and more specifically to the image development and paper registration control systems therefor.

In a typical electrophotographic copier, light directed to a document or other material being copied is reflected and focused onto a photoconductive surface. This surface has the property that it can accept and retain an electrostatic charge until it is illuminated, at which time the charge will substantially dissipate in proportion to the intensity of the light energy incident thereon. Thus when a focused and reflected image of the document, composed of myriad light components of varied brightness, is incident on the photoconductive surface, the areas of the surface illuminated by the brighter components will lose more charge than the areas illuminated by the less bright components. The result is a latent electrostatic image within the photoconductive surface, composed of an aggregation of charges. At a later point in the copying process, the latent image is developed by allowing charged toner particles, in either a dry or a liquid form, to be attracted toward the charged surface. The developed image is then transferred onto paper or another medium.

However, due to the rapid processing times associated with modern high speed copiers, often the most brightly illuminated areas of the photoconductive surface, which are receiving light from the white, or background, areas of the document, do not have sufficient time to dissipate the appropriate amount of their electrostatic charge. This problem is further complicated by the fact that the rate of discharge is not constant with time, but it slows down as the amount of charge decreases. As a result, a residual potential remains on the photoconductive surface corresponding to the background area which will during normal development attract the toner particles and produce a gray or dirty background in the final copy, instead of the desired white or clean background area. In addition, the background areas of documents printed on colored or off-white paper, which have lower reflectivities than a white background, will produce a higher background residual potential on the photoconductive surface than would the white paper, resulting in a gray background in the finished copy. To counteract these problems, it is known in the prior art to position an appropriately shaped development electrode close to the photoconductive surface at the point where the toner particles are deposited and to impress on the electrode a bias potential of the same polarity as the potential on the photoconductive surface. In a positive development system, this bias potential, if greater than the residual potential present on the photoconductive surface, will cause the toner particles to be attracted to the electrode rather than to the residually charged surface areas, and thus prevent the gray or dirty effect.

In the prior art, systems for imposing a fixed bias and systems for imposing a variable bias on the development electrode are well known. Typical variable bias systems can use a photodetector positioned so as to receive light reflected from the document being copied. Since the residual potential on the photoconductive surface is dependent on the intensity of the incident light, a measurement of the brightness of the reflected light during a particular cycle can be calibrated to provide a reliable indicator of the residual potential on the photoconductive surface after illumination by that same light.

In order for the previous biasing systems to be effective, however, it was necessary to insure that a photodetector would have an unobstructed view of an unmarked portion of the background of the document, for example, the margins. This constraint makes necessary either a sophisticated optical system to maintain precise alignment of the photodetector's field of view with the area of interest or an array of photodetectors aimed at various spots on the document, one of which was presumed likely to see an unmarked area. Either of these alternatives means extra expense.

Another critical function within the typical copier is the feeding of the material onto which will be transferred the developed photographic image. The transfer material must arrive at the photoconductive surface at the proper instant to insure that there will be registration or alignment of the complete image with the transfer material.

Therefore it is an object of the invention to be responsive to the reflectance characteristics of a document being copied so as to produce a finished copy combining good contrast and a shadow-free background, and to do so in a simple, reliable, and efficient manner, utilizing a minimum of components.

It is a further object of the invention to respond to reflected light of a predetermined intensity to initiate sheet feed to achieve proper registration with the image being transferred from the photoconductive surface.

SUMMARY OF THE INVENTION

The present invention relates to a control signal-generating apparatus for use in an electrophotographic copier in which the image of a document is optically produced on a photoconductive surface. The copier has an optical imaging assembly for focusing light from a document illumination source and reflected from the document onto said photoconductive surface; a development station having a development electrode capable of accepting an electrical potential and closely spaced to the photoconductive surface; and a transfer station having a device for positioning a medium adjacent the photoconductive surface for transferral of the image thereon.

The invention features an apparatus for generating and applying an electrical potential to the electrode, which includes a system for moving either the illumination source or the document for progressively illuminating the document; and a photoelectric detector disposed to intercept an unfocused portion of the light energy reflected from the document toward the photoconductive surface, and then generate an output signal in response thereto. A device determines when the reflected light energy corresponds to the scanning of a central portion of the document, and a signal generator, responsive to both the detector output and this determining device, generates an electrical potential to be applied to the development electrode. In this manner, the magnitude of the potential is dependent on the light energy received by the photoelectric detector from the central portion of the document as compared to a predetermined standard reflectivity value.

In an alternate embodiment, the invention also includes a reflective strip positioned adjacent a leading edge of the document. This strip has a predetermined high reflectivity in a known spectral bandwidth. The illumination source progressively scans the reflective strip and then the document, and the photoelectric detector produces a predetermined output in response to the light reflected from the reflective strip. The signal generator, actuated by this predetermined output, produces a control signal which actuates the copy medium positioning device.

A distinctive feature of the invention is that the signal-generating circuit receiving its input from the photodetector remains passive until the signals correspond to the light from the high-reflectivity strip. Thereafter the signals from the body of the document at a predetermined distance from the document's leading edge, which distance is determined by passage of a precise time interval after reception of the distinctively bright light from the high-reflectivity member, are processed. Since the photodetector receives the reflected light at an out of focus position, the intensity of the light which it "sees" is not due to any one specific small area on the document surface, but instead is made up of contributions from a multitude of areas across the portion of surface being illuminated. This insures that in general the single fixed photodetector receives some light reflected from background areas of the document, as well as from printed areas.

Thus instead of having to scan an unmarked background area of the document which entails precise alignment, as previously discussed, the present invention measures reflected light from the main body of the document, where print or other indicia are likely to be found, but where their effect on the reflected light can be taken into account. In other words (a) by estimating an anticipated density of, for example, typewritten matter on a page (assuming that it remains generally constant across the document surface of interest), (b) by defining a standard white background for the page, and (c) by determining the photodetector output corresponding to such a background having that print density, it has been possible to calibrate the electronic circuit to produce a bias voltage which achieves a satisfactory compromise between cleanliness of background and contrast between the toned areas and the background. The electronic circuit provides a range of bias voltages extending on either side of this particular value. If the amount of reflected light detected should be less than this reference value, either because of a darker background paper or a higher density of print, the bias voltage will increase in magnitude. In the case of the darker background, this higher bias voltage counteracts the resulting higher residual voltage on the photoconductive drum to maintain the clean background. In the case of the higher print density, the higher bias, although not needed to counteract a higher background voltage, will attract loose excess toner particles deposited in the printed areas and so reduce the possibility of particles migrating to adjacent background areas and turning them gray in the finished copy. Conversely, if the amount of detected light should be more than the reference value, the bias voltage will decrease in magnitude.

The preferred embodiment also features a hollow tube which restricts the photodetector's field of view to prevent stray light from creating what would be a false reading by the detector. Another feature according to a preferred embodiment of the invention is a filter placed ahead of the photodetector to insure a uniform response by the photodetector within the spectral range of interest, taking into account the illuminating light, even if the photodetector has a substantially higher sensitivity to one or more particular light wavelengths.

The high-reflectivity strip also is designed to have a reflectivity significantly higher than the most reflective area of typical expected documents, so the intensity of light reflected therefrom accordingly will be higher than normally expected, and it is the distinctively high photodetector output resulting from this light which is sufficient to overcome an activation threshold of the associated electronic circuit. The reception of this signal thus serves as a reference time baseline in the copying cycle and can be used to initiate the feed of the copy paper, after precisely preset time delays.

BRIEF DESCRIPTION OF THE DRAWINGS

Other objects, features and advantages of the invention will appear from the following description of a preferred embodiment and the drawings in which.

DESCRIPTION OF A PREFERRED EMBODIMENT

Figure 1:
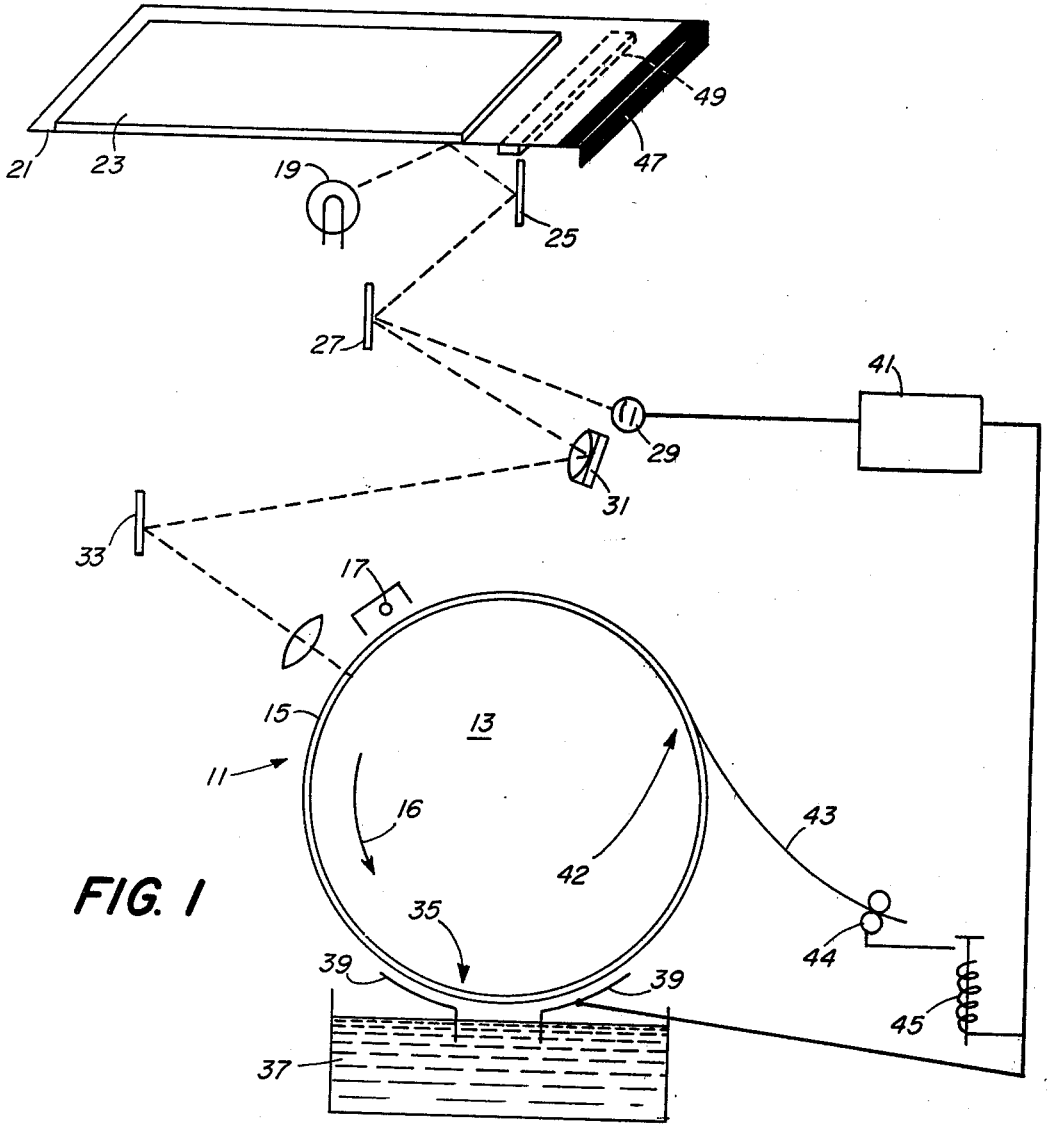
FIG. 1 is a simplified schematic front elevation view of a photocopier in which the present invention is incorporated.

Referring to FIG. 1, a typical photocopier 11 in which the present invention can be employed has a drum 13 with a photoconductive surface 15 such as selenium thereon, rotating in the direction indicated by an arrow 16. A charge corona 17 located in close proximity to drum 13 charges the photoconductive surface to about +1400 volts DC. The light from a light source 19, such as a quartz halogen lamp, is directed through a transparent document support plate 21 onto a limited area of the surface of a document 23 to be copied. Typically the light source 19 is directed so that only a thin strip extending across the full width of the document is illuminated at any one time. The light is reflected by the document onto a first mirror 25 and then in turn onto a second mirror 27. Of the light reflected from the second mirror 27, a portion impinges onto a photodetector 29 and a second portion is focused and further reflected by a lens-mirror combination 31. The light beam exiting from the lens-mirror combination 31, strikes a fourth mirror 33 and is reflected onto the photoconductive surface 15. The light causes increased conduction in the illuminated portions of the charged photoconductive surface 15 so as to form a latent electrostatic image having a pattern of electrical charges on the surface 15. The illustrated light source 19 and the mirrors 25 and 27 are movable, as hereinafter described more fully, so that the entire surface of the document 23 is illuminated progressively. Alternatively the document plate 21 may be moved, while the light source and optical system remain stationary, or there may be a combined movement of all of these components, so as to achieve the same result. Thus the document image can be reflected strip by strip, in a continuous fashion, onto the synchronously moving photoconductive surface 15. The rotating drum 13 transports the latent image to a development station 35 where a liquid developer 37 having a negatively charged toner will contact the electrostatic image to develop it. A development electrode 39 has a positive bias potential imposed on it by a bias and control circuit 41 controlled by the photodetector 29. The magnitude of this potential is determined by the intensity of the light sensed by the photodetector 29 at a particular time, as hereinafter explained. The electrode 39 is located close to the surface 15 and serves to counteract any residual background potential remaining thereon.

The surface 15, bearing the now-developed image, proceeds to a transfer station 42 where the image will be transferred to a copy material 43. The copy material is advanced toward the drum surface at the appropriate time and speed so that the leading edge of the material will coincide with the leading edge of the developed image on the drum. A feed mechanism 44 for the copy material, typically clutch controlled registration rollers, is initiated by energizing a registration clutch solenoid 45. The solenoid 45 is controlled by the bias and control circuit 41 in response to the receipt of a selected predetermined input from the photodetector.

Figure 2:
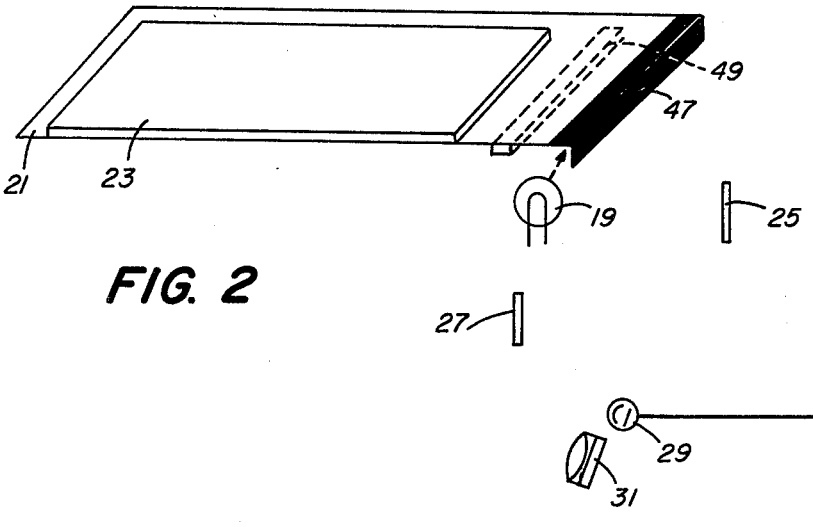
FIGS. 2–4 are schematic views similar to FIG. 1, showing the relative positions of the illumination source and mirrors during operation of the copier.

Referring to FIG. 2, the light source 19 and the mirrors 25, 27 are shown in their initial positions prior to initiation of a typical copying cycle. The light source is disposed directly below a bracket 47 painted flat-black so that it is essentially non-reflective. Thus no light from the light source 19 is reflected by the mirrors 25 and 27 to the photodetector 29. This positioning is desirable to prevent premature activation of the bias and control circuit by stray light impinging on the photodetector 29.

Figure 3:
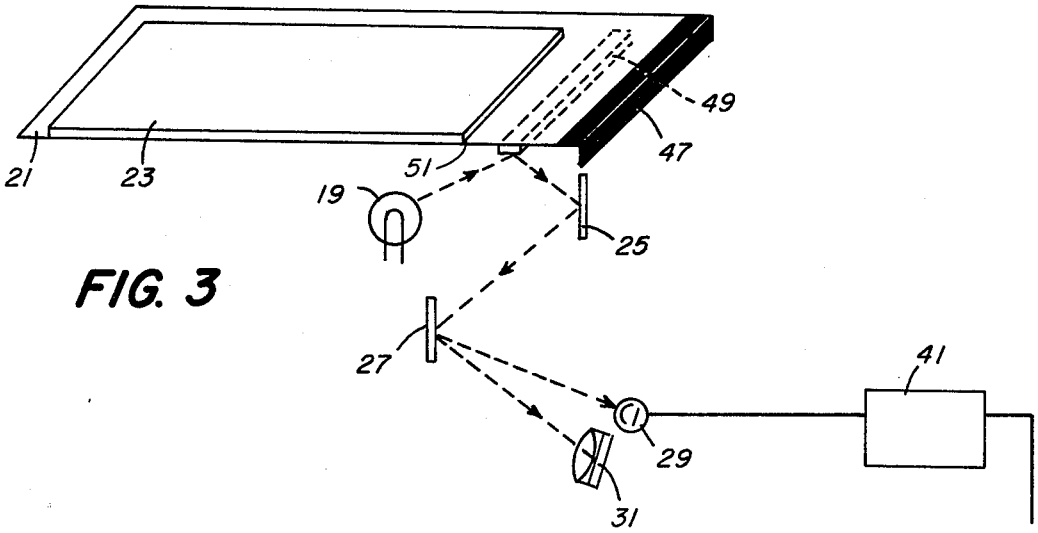

Upon initiation of a copying cycle by an operator, the light source 19 and the first mirror 25 will begin to move (by a mechanism not pertinent to the present invention) to the left in a direction parallel to the document support plate 21 and the document 23. The light source and mirror 25 move at the same speed as the photoconductive surface of the drum, in the case of a 1:1 reproduction, although the speed relationships will be different for the case of either a reduced or an enlarged reproduction. The second mirror 27 also will move to the left, but at only one-half the speed of the light source and the first mirror so that the total distance travelled by light reflected from the surface of the document 23 to the lens-mirror (see FIG. 1) will remain constant, thereby keeping the image of the document 23 in proper focus at the drum surface. As seen in FIG. 3 the first reflection of light source 19 will occur when the light source becomes positioned beneath a highly-reflective strip 49 which is placed just before a leading edge 51 of the document 23 and is coextensive with its width. This reflective strip preferably has a titanium-white surface possessing exceptionally high reflectivity in the visible spectrum, higher than the expected reflectivity of white areas on typical documents. A portion of the light reflected from the highly-reflective strip 49 is directed by the mirrors 25 and 27 onto the photodetector 29. The exceptionally high detected intensity of this light produces a correspondingly high level signal output from the photodetector, and this high level signal will exceed a preset threshold level within the bias and control circuit 41 (as hereinafter discussed with reference to FIG. 6) to initiate the generation of the development electrode potential and the registration solenoid energizing signal as described in detail hereinbelow.

Figure 4:
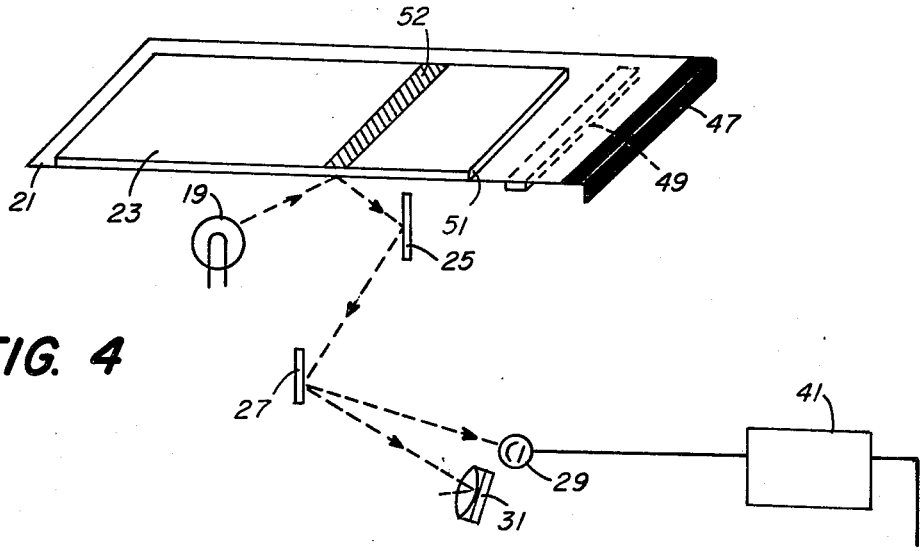

Referring to FIG. 4, the light source 19 has continued its movement to a position beneath the document 23, about one-third of the way from the leading edge 51, and is illuminating a thin strip 52 of the document. The mirrors 25 and 27 have moved accordingly. As described above, with reference to FIG. 1, the light energy is reflected onto the surface 15 of the drum 13, and as the light source 19 and the mirror 25 proceed along the face of the document at the same speed as the photoconductive surface is moving (for 1:1 reproduction), the image of the entire document will be reproduced in continuous fashion on the surface 15. Simultaneously, a portion of the light being reflected from the document (FIG. 4) is incident on the photodetector 29 and conveys information about the reflectivity of this particular document which will determine the magnitude of the development electrode biasing potential generated by the bias and control circuit 41.

Figure 5:
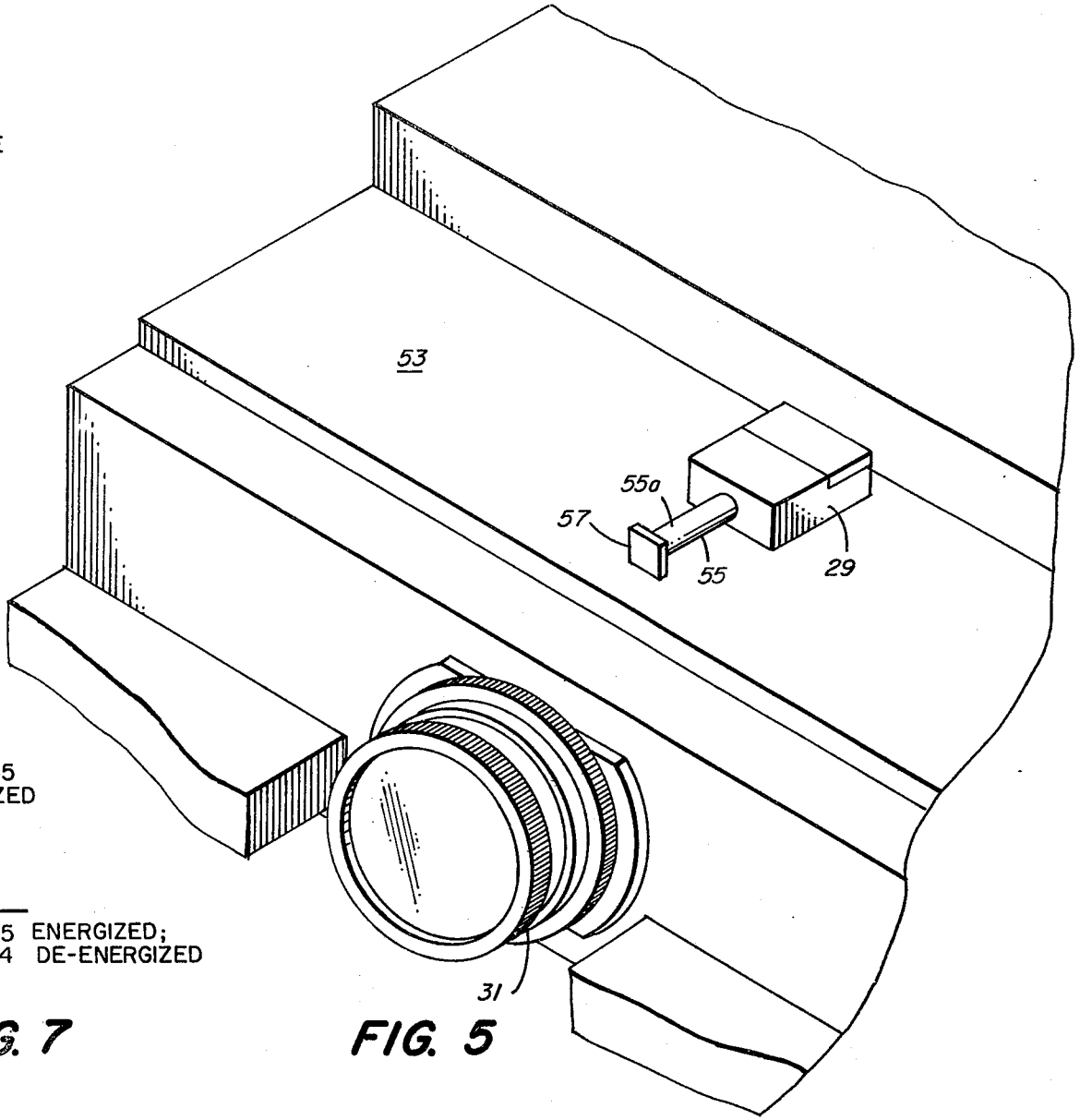
FIG. 5 is a fragmentary detail view of the photodetector and the lens-mirror as positioned within the photocopier.

In FIG. 5, the photodetector 29 is mounted on a chassis 53 in proximity with the lens-mirror combination 31, and is directed toward the incoming light reflected from the document via the mirrors 25, 27 (see FIG. 4). Since the photodetector is intercepting unfocused reflected light, the incident light contains components emanating from all areas within the particular strip 52 of the document being illuminated at any particular instant of time, rather than from merely an isolated area along this strip. This insures that the light information received by this single photodetector is a reliable indicator of the average reflectivity of the document. In the illustrated embodiment, a tube 55 approximately one inch long, and attached to the photodetector, has an opaque sidewall **55*a* which restricts the field of view of the photodetector's light sensitive surface (not shown), so that only light coming from the second mirror 27 (see FIG. 1) and not stray light, affects the output of the photodetector 29. A filter 57 can be, and in the preferred embodiment is, mounted over the entrance to the tube 55** to equalize the light response of the photodetector over the spectral range of interest, in case it should be objectionably sensitive to one or more specific colors or wavelengths. Otherwise if the document being copied used paper, type or indicia of those colors, the photodetector would produce an inordinately high output, possibly resulting in an inadequate development electrode bias potential and a copy with too dark a background.

Figure 6:
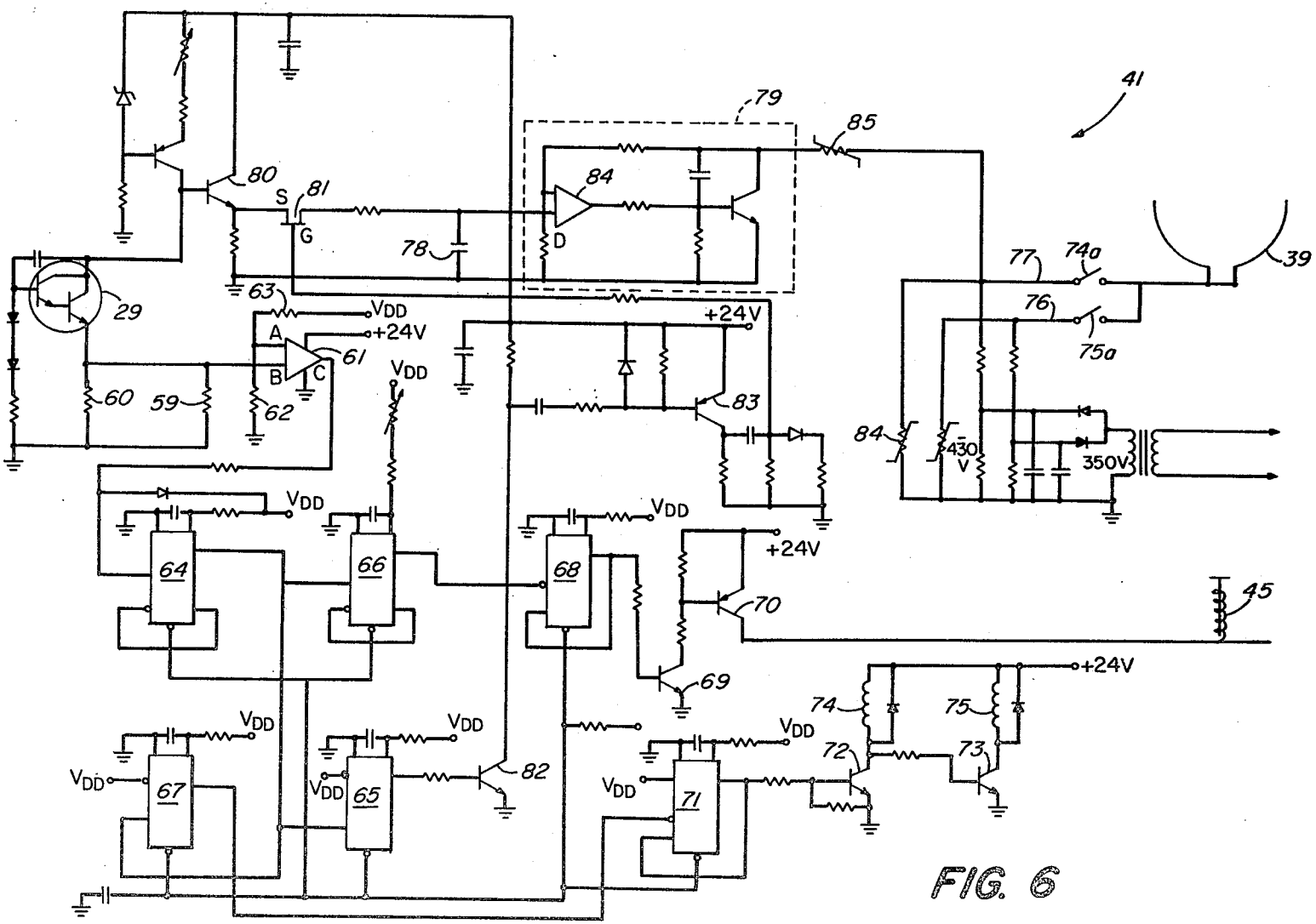
FIG. 6 is a schematic diagram of the bias and control circuit.

A detailed discussion of the electronics of the bias and control circuit 41 will reveal precisely how the generation of the development electrode potential and the registration solenoid energizing signal are accomplished. Referring to FIG. 6, the electrical circuit, prior to initiation of a copy cycle, is in a "passive" condition. The photodetector 29, here an FTP 400 Darlington phototransistor, manufactured by Fairchild Semiconductor Co. located in Sunnyvale, California, has a collector-emitter current which is directly proportional to the amount of light incident upon its photosensitive surface. When no light is incident on the photodetector, as for example when the light source is in the initial position as depicted in FIG. 2, the photodetector will not conduct. However when there is sufficient light to cause the photodetector to conduct, a voltage developed across resistors 59 and 60 will appear at pin B of a comparator 61. A preset voltage determined by a voltage $V_{DD}$ and resistors 62 and 63 exists at pin A of the comparator, and as long as the voltage at pin B does not exceed the voltage at pin A, the output of the comparator 61 at pin C will be 0 V and the circuit remains in its "passive" state. The preset voltage is sufficiently high so that only an amount of light energy corresponding to that reflected from the titanium-white highly-reflective strip (see FIG. 3) will be adequate to generate the minimum required collector current through the photodetector. When the light from the highly-reflective strip impinges on the photodetector, and the voltage at pin B exceeds that at pin A, the output of the comparator 61 will switch from 0 V to +23 V and the circuit thereby enters an "active" operating condition.

The +23 V signal turns on a monostable multivibrator or "one-shot" 64, which in turn generates a pulse approximately 0.8 second long, a sufficient time duration to insure that it stays on and is not multiply-pulsed during the brief time period that the photodetector is being illuminated by light from the reflective strip. The leading edge of the pulse from the one-shot 64 produces additional timing pulses of 0.4, 0.7 and 0.25 second from respectively one-shots 65, 66 and 67 (see also FIG. 7). The trailing edge of the pulse from the one-shot 66 activates still another one-shot 68 which turns on transistors 69 and 70, for approximately 0.5 second. This delivers a +24 V energizing signal to the registration solenoid 45 for the duration of the pulse from the one-shot 68. As discussed above, energizing the registration solenoid starts the copy paper feed mechanism to insure arrival of the copy paper at the drum surface at the appropriate time to produce registration with the developed image thereon.

When the one-shot 67 has completed its pulse, it then triggers a one-shot 71 which in turn pulses for approximately 1.5 seconds to cause transistors 72 and 73 simultaneously to energize a relay 74 and de-energize a relay 75, which closes a contact 74*a* and opens a contact 75*a*. This disconnects the development electrode from a −430 Volt "cleaning" potential, supplied on a line 76, and connects it to a nominal bias potential, between 150 V and 330 V, supplied on a line 77. This nominal potential is determined by the residual voltage left on a capacitor 78 from the previous copying cycle, which voltage biases a shunt voltage regulator 79, and the potential will be adjusted either up or down to the final bias potential by the regulator 79, as follows.

Shortly after the photodetector 29 has been illuminated by the light from the reflective strip, it will be illuminated by lower intensity light reflected from the document, at an area about one-third of the way in from its leading edge 51 (see FIG. 4). This light level will produce a corresponding voltage at the collector of the photodetector 29 which voltage will be imposed through a transistor 80 onto a source S of a field-effect transistor, or FET, 81. At the completion of the 0.4 second pulse from the one-shot 65, transistors 82 and 83 generate a positive signal pulse to a gate G of the FET 81, thereby turning on the FET long enough for the capacitor 78 to be charged to the level of the voltage appearing at the source S of the FET 81. This new voltage level on the capacitor 78 provides an input to a pin D of an operational amplifier 84 of the shunt voltage regulator 79. The regulator 79, in accordance with the voltage on the capacitor 78, determines the final positive bias voltage to be applied to the development electrode 39 for the present copying cycle and adjusts the nominal voltage accordingly. The higher the voltage on the capacitor 78, the higher the positive bias voltage. The upper and lower limits of this bias voltage are fixed by varistors 84 and 85 respectively. In the present embodiment the upper limit is set at 330 V (varistor 84) and the lower limit at 150 V (varistor 85).

Figure 7:
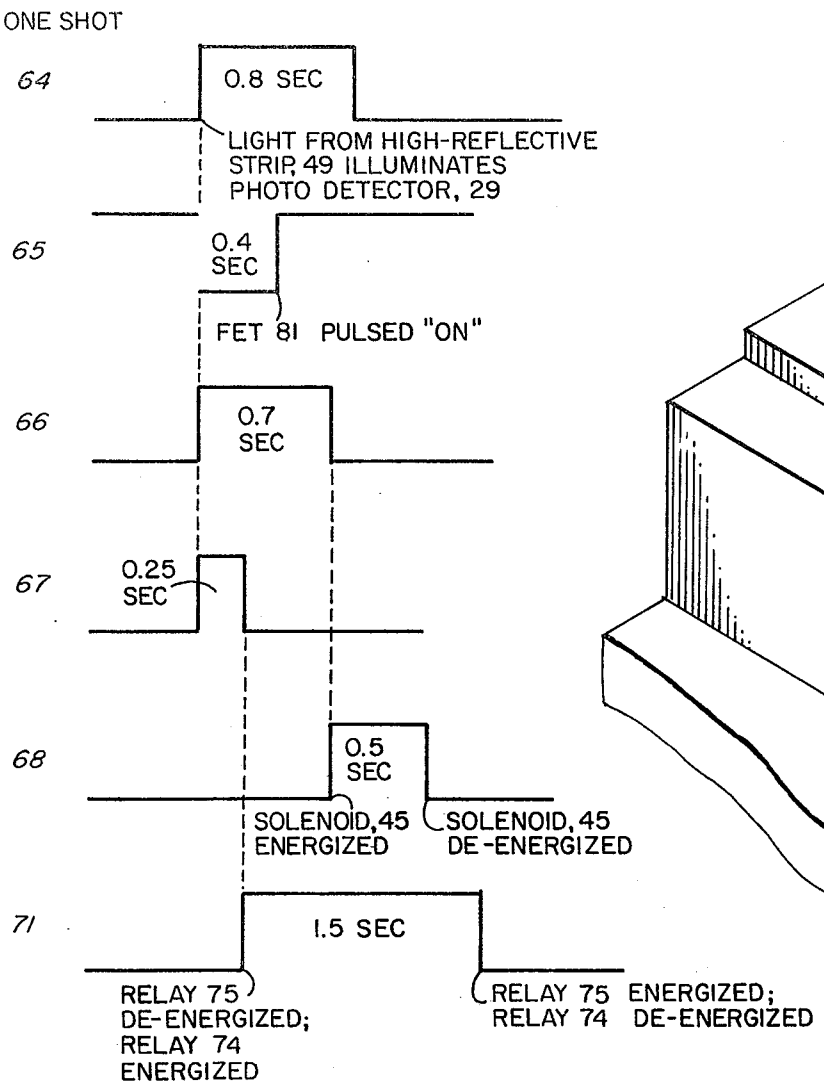
FIG. 7 is a diagram showing the temporal relationship of the various timing pulses generated by the bias and control circuit.

At the completion of the pulse from the one-shot 71, the relays 74 and 75 will be de-energized and energized respectively, thereby opening the contact 74*a* and closing the contact 75*a* and reconnecting the development electrode 39 to the −430 V cleaning potential on the line 76. The bias and control circuit thus returns to its "passive" state and is ready for the next copying cycle. FIG. 7 illustrates the timing sequence of the various pulses and the operations described above.

The magnitude of the development electrode bias being generated in response to the light received by the photodetector is predicated on some assumptions and experimentally verified operating parameters based thereon. One assumption is that the majority of documents likely to be copied are typewritten letters on white bond with double spacing between lines. Therefore a sheet of white bond typing paper having a 25% cotton fiber content (such as Trojan Bond - Radiant White, made by Eagle Papers Division of the Brown Company, Holyoke, Massachusetts) was selected to serve as a "standard white background" document, and typing double-spaced thereon with an IBM "Prestige PICA 72 (Legal)" font and an IBM High Yield Correctable Ribbon provided a "standard document".

Figure 8:
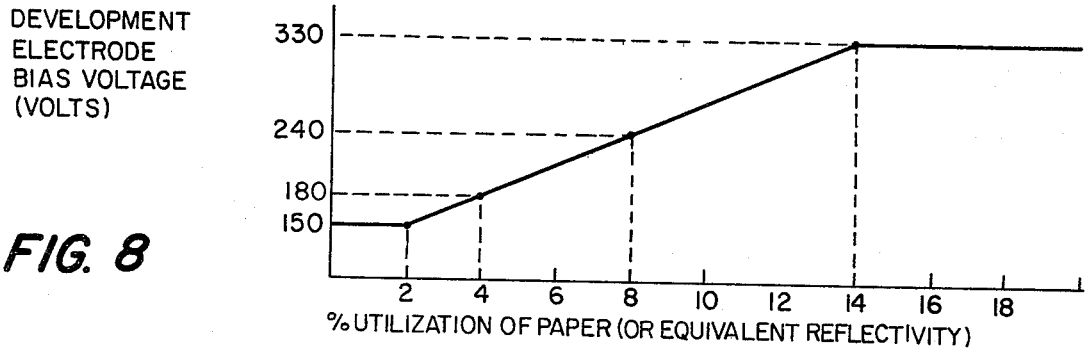
FIG. 8 is a diagram showing the relationship between the reflectivity of the document being copied and the development electrode bias.

In the body of such a document, approximately 4% of the unit surface area will be covered by typed characters. For ease of consideration, a measure of the reflection of a document, termed "utilization" will be introduced. The utilization factor of a document equals $(R_o-R)/R_o$ where $R_o$ is the reflectivity of a blank document having a standard white background and R is the reflectivity (in the same units as $R_o$) of an unknown document. Thus, a "standard document" has about a "4% utilization" corresponding to black print over about 4% of its surface. Referring to FIG. 8, test results based on the reflectivity of a "standard document" have shown that a development electrode bias of approximately 180 volts will yield optimum clarity and contrast in the resulting copy.

Clearly, different documents have different average reflectivities because of, for example, a difference in the background paper color, density of the typed lettering in the background, or even the color of the ink. Thus, for a single-spaced, typewritten document having a standard white background there is approximately twice as much loss of the reflected light when compared to the "standard document"; and this corresponds to an 8% utilization. Referring to FIG. 8, a bias of 240 volts is thus provided for this single-spaced document. Correspondingly, for a smaller utilization factor corresponding to a document having a higher average reflectivity than the "standard document", a bias swing in the direction of potentials less than 180 volts will be called for. In the preferred embodiment the allowable range of bias is from 150 to 330 volts.

Thus, a particular utilization factor can be obtained from a combination of many parameters and corresponds to the total average reflectivity from the particular document. Thus, a 4% utilization, which corresponds to a "standard document", can be produced by a document having a less densely spaced type on a lower reflectivity background, for example colored paper, or a document having more densely spaced type on a higher reflectivity background, for example a super-white background.

Thus, the photoelectric detector, which responds solely to the average amount of light being reflected from the document, regardless of the source of the reflection, and the connected circuitry provide, for each value of average reflectivity, a corresponding electrode bias. The term "utilization" is therefore a convenient way to label the reflectivity which generates a predetermined bias on the electrode. Generally, the reflectivity for the class of documents being copied will be more affected by the background reflectivity of the document than the density of information on the document; and hence, it is the background of the document which primarily determines the electrode bias.

SUMMARY OF THE MAJOR ADVANTAGES OF THE INVENTION AND NON-OBVIOUSNESS

A careful consideration of the features of the present invention will reveal several distinguishable advantages over devices and teachings known in the prior art.

The effective placement of a single photodetector within the light-imaging network produces an inexpensive yet effective system for controlling the quality of the finished copy. Whereas many previous systems are predicated on the necessity of detecting reflections from isolated, unmarked portions of the document being copied in order to produce an effective development electrode bias, the present invention is based on the realization that adequate results can be achieved at a significantly lower cost by detecting reflections from a broader, more easily viewable area on the document. The amount of reflectivity which serves as the reference standard for adjustment of the bias potential is not that of a pure white document, but rather that of an area of a "standard white background" document having the density of printed indicia most commonly encountered in typewritten documents, i.e. a 4% utilization of the background.

Since according to the invention it is not critical to view a tightly restricted area of the document so as to be insured of "seeing" only a white marginal area of the document, the photodetector can be placed farther from the document, that is, at a point at which the image is not focused, farther along the optical path toward the photoconductive surface, with the beneficial result that the intensity of the light received by the photodetector is more representative of the light which ultimately will be focused onto the photoconductive surface. Additionally, the light impinging on the photodetector originates from the same light source used to project the document image onto the photoconductive surface, and the detection occurs simultaneously with the imaging cycle, so there can be no discrepancies due to differences in intensities of light sources, or differences in intensities of the same source at two distinct instants of time. In other words the in-process, in-line nature of the photodetector's measurements are more representative of the actual light conditions at the photoconductive surface than would be measurements made using separate light sources and/or optical systems, or made during a separate procedure prior to the actual copying cycle.

The disclosed system is different than and distinguished from the structures disclosed by the following typical prior art references. U.S. Pat. Nos. 4,124,295 to Gardiner and 4,153,364 to Suzuki et al. do not disclose systems in which a single photodetector receives light simultaneously from a relatively large area of the document, but rather systems in which multiple detectors each "see" only a small portion of the document. In addition, Gardiner uses multiple light sources, separate from the image-producing source, to provide the light for the photodetectors.

The system disclosed by U.S. Pat. No. 3,563,143 to Petersen also utilizes more than one photodetector. Further, the disclosure does not discuss a structure for achieving the result described hereinabove, and in particular does not disclose the photodetector positioning described herein, and so does not lead the reader to the present invention.

In U.S. Pat. Nos. 3,438,705 to King, 3,914,049 to Basu et al., and 3,438,704 to Schoen, the photodetector "sees" only focused light, unlike the present invention. Furthermore, in both King and Schoen the light received by the photodetector has not been reflected from the document being copied, but from a reference reflective strip. And in neither case does the light from the reflective strip trigger the timing of the bias circuit or initiate the sequencing of other copier functions. Instead, it is intended to simulate, but is independent of, the light reflected from the document background for, respectively, determining the development electrode bias and controlling the lamp illumination level.

In the disclosures of both U.S. Pat. Nos. 3,609,038 to Kolshorn and 3,279,312 to Rogers unfocused light from the document is being sensed, but at a point in advance of the position where the document is actually copied. Further, the photodetector receives the light directly from the document, and thus the condition being sensed is not truly indicative of the ambient lighting which will operate on the photoconductive surface, since it is being done at a different time, while looking in a different direction.

Further, the use of the titanium-white reflective strip to initiate the timing sequence in the present invention offers an additional advantage. It further removes the need for a separate detecting device such as a microswitch or another photodetector to initiate, e.g., the feed of copy paper. Rather, the existing photodetector serves a dual purpose, and elimination of a component generally means increased reliability and lower cost of the copier.

Modifications of the disclosed embodiment are contemplated and would be within the scope of the invention. For example, any of a variety of photosensitive devices may serve as the photodetector. The number and orientation of mirrors in the optical system are not critical, as long as the photodetector is positioned to intercept an unfocused portion of the beam. The particular electronic circuitry to achieve the timing sequence may be replaced by functional equivalents. Either the light source, the optical system, and/or the document platen can be movable as long as the light first strikes a high-reflectivity strip before "scanning" the document. And positive or negative toner can be employed (with the consequent changes of voltage as needed) to effect a desired copy operation.

Thus additions, subtractions, deletions and other modifications of the disclosed embodiment will be obvious to those skilled in the art and are within the scope of the following claims.

What is claimed is:

1. In an electrophotographic copier in which the image of a document is optically produced on a photoconductive surface, said copier having an optical imaging assembly for focusing light from a document illumination source and reflected from said document onto said photoconductive surface, means for moving at least one of said illumination source and said document for illuminating progressively said document;

a development station wherein a development electrode is closely spaced to the photoconductive surface, a transfer station including means for positioning a copy medium adjacent said photoconductive surface for transfer of the image thereon, and apparatus for generating and applying an electrical potential to said electrode, said apparatus comprising:

a photoelectric detector disposed to intercept an unfocused portion of the light energy reflected from said document toward said photoconductive surface, and for generating an output signal in response thereto;

means for determining when said reflected light energy corresponds to scanning of a central portion of said document, and a signal generating means responsive to said output of said detector and said determining means for generating an electrical potential to be applied to said development electrode, whereby the magnitude of said potential is dependent on the light energy received by said photoelectric detector from said central portion of the document relative to a predetermined standard reflectivity value.

2. The apparatus as set forth in claim 1 wherein said predetermined reflectivity is that of a standard white background document having a 4% utilization of the paper.

3. The apparatus as set forth in claim 2 wherein said central portion of the document is one-third of the way in from a leading edge of said document.

4. The apparatus as set forth in claim 1 further comprising a field of view restriction means for restricting the field of view of said detector to substantially an optical path of said copier.

5. In an electrophotographic copier in which the image of a document supported on a document plate is optically produced on a photoconductive surface, said copier having an optical imaging assembly for focusing light reflected from said document onto said photoconductive surface, a development station wherein a development electrode is closely spaced to the photoconductive surface, a transfer station including means for positioning a copy medium adjacent said photoconductive surface for transfer of the image thereon, and apparatus for generating an electrical control signal for said copy medium positioning means, said apparatus comprising:

a reflective member disposed adjacent a leading edge of said document plate, said member having a predetermined high reflectivity in a known spectral bandwidth;

means for illuminating progressively said reflective member and said document for scanning said document;

a photoelectric detector responsive at least to said spectral bandwidth and disposed to intercept a portion of the light energy reflected from said reflective member and said document during said progressive illumination; and a signal generating means actuated by a predetermined output of said detector caused by light reflected from said reflective member for producing a control signal to actuate said copy medium positioning means.

6. The apparatus as set forth in claim 5 further comprising means for mounting said detector adjacent a lens member of said optical system for intercepting an unfocused portion of the reflected light energy from said reflective member.

7. The apparatus as set forth in claim 5 wherein said generating means comprises at least one electrical delay element for delaying an actuating signal to said positioning means.

8. In an electrophotographic copier in which the image of a document supported on a document plate is optically produced on a photoconductive surface, said copier having an optical imaging assembly for focusing light reflected from said document onto said photoconductive surface, a development station wherein a development electrode is closely spaced to the photoconductive surface, a transfer station including means for positioning a copy medium adjacent said photoconductive surface for transfer of the image thereon, and apparatus for generating and applying an electrical potential to said electrode and for generating an electrical control signal for said copy medium positioning means, said apparatus comprising:

a reflective member, disposed adjacent a leading edge of said document plate, said member having a predetermined high reflectivity in a known spectral bandwidth;

a light source;

means for moving one of said light source and said document plate for illuminating progressively said reflective member and said document;

a photoelectric detector responsive to at least a portion of said light source output and disposed to intercept an unfocused portion of the light energy reflected by said reflective member and said document toward a focusing lens, for generating an output signal in response thereto; and a signal generating means responsive to the output of said detector which exceeds a first threshold for generating a first timing signal for actuating said copy medium positioning means, and responsive to the output of said detector at a predetermined time after generation of said first timing signal for generating said electrical potential to be applied to said development electrode, whereby said detector output which exceeds said first threshold corresponds to light energy reflected by said reflective member.

9. The apparatus as set forth in claim 8 wherein said predetermined time is of sufficient duration that the output of said detector is due to light reflected from a central portion of said document.

10. The apparatus as set forth in claim 9 wherein said central portion is one-third of the way in from said leading edge of said document.

11. The apparatus as set forth in claim 8 wherein the signal generating means comprises means for generating said electrical potential in response to the output of said photodetector due to the reflectivity of a central portion of the document relative to a predetermined reflectivity value.

12. The apparatus as set forth in claim 11 wherein said predetermined reflectivity value is that of a standard white background document having 4% utilization of the paper.

13. The apparatus as set forth in claim 8 further comprising a filter positioned in front of said photodetector to equalize the wavelength sensitivity of said detector to said light source.

* * * * *